US011952864B2

(12) United States Patent
Walther et al.

(10) Patent No.: US 11,952,864 B2
(45) Date of Patent: Apr. 9, 2024

(54) DISENGAGING PISTON FOR LINEAR ACTUATION

(71) Applicant: Schlumberger Technology Corporation, Sugar Land, TX (US)

(72) Inventors: Brian Walther, Missouri City, TX (US); Bo Chen, Stanford, CA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/004,360

(22) PCT Filed: Jul. 7, 2021

(86) PCT No.: PCT/US2021/040656

§ 371 (c)(1),
(2) Date: Jan. 5, 2023

(87) PCT Pub. No.: WO2022/010993

PCT Pub. Date: Jan. 13, 2022

(65) Prior Publication Data

US 2023/0279737 A1 Sep. 7, 2023

Related U.S. Application Data

(60) Provisional application No. 63/049,793, filed on Jul. 9, 2020.

(51) Int. Cl.
*E21B 34/08* (2006.01)
*E21B 34/14* (2006.01)

(52) U.S. Cl.
CPC ..... *E21B 34/08* (2013.01); *E21B 34/14* (2013.01); *E21B 2200/04* (2020.05)

(58) Field of Classification Search
CPC ..... E21B 34/14; E21B 34/08; E21B 34/06; E21B 2200/04
See application file for complete search history.

(56) References Cited

U.S. PATENT DOCUMENTS

2009/0218104 A1 9/2009 Brown
2015/0308206 A1 10/2015 Yue
(Continued)

FOREIGN PATENT DOCUMENTS

EP 1771639 B1 9/2012
WO 2012040235 A2 3/2012

OTHER PUBLICATIONS

International Search Report and Written Opinion issued in the PCT Application PCT/US2021/040656, dated Nov. 3, 2021 (9 pages).

*Primary Examiner* — Yong-Suk (Philip) Ro
(74) *Attorney, Agent, or Firm* — Jeffrey D. Frantz

(57) ABSTRACT

An isolation valve includes a ball valve element, an actuation section to rotate the ball valve element, and a trigger section that actuates the actuation section in response to a pressure differential. The actuation section includes an actuation mandrel, a piston housing that at least partially encases the actuation mandrel, a collet piston, and a holding collet. The piston housing and the actuation mandrel define a hydraulic chamber, and the collet piston separates the hydraulic chamber into an upper hydraulic chamber and a lower hydraulic chamber. The holding collet supports the collet piston during a stroke of the actuation mandrel that is triggered by the trigger section. The collet piston is configured to assume a rest position on the actuation mandrel before and during the stroke of the actuation mandrel, and the collet piston is configured to disengage from the actuation mandrel after the stroke of the actuation mandrel.

15 Claims, 7 Drawing Sheets

(56) References Cited

U.S. PATENT DOCUMENTS

| | | | | |
|---|---|---|---|---|
| 2019/0145220 | A1* | 5/2019 | Patel | E21B 34/14<br>166/375 |
| 2019/0264536 | A1 | 8/2019 | Abeidoh | |
| 2022/0186585 | A1 | 6/2022 | Elston | |

* cited by examiner

DISENGAGING PISTON FOR LINEAR ACTUATION

CROSS-REFERENCE TO RELATED APPLICATION

The present document is the National Stage Entry of International Application No. PCT/US2021/040656, filed Jul. 7, 2021, which is based on and claims priority to U.S. Provisional Application No. 63/049,793, filed Jul. 9, 2020, which is incorporated herein by reference in its entirety.

BACKGROUND

Hydrocarbon fluids such as oil and natural gas are obtained from a subterranean geologic formation, referred to as a reservoir, by drilling a wellbore that penetrates the hydrocarbon-bearing formation. Once the wellbore is drilled, various forms of well completion components may be installed to control and enhance the efficiency of producing the various fluids from the reservoir.

Isolation valves safeguard reservoirs by providing a reliable barrier within the completion tubing string. Isolation valves may utilize a ball valve as the primary barrier mechanism, and the ball valve can be actuated to open and close by a variety of different means (e.g., hydraulically or mechanically). In isolation valves that implement a one-time remote open triggering event for actuating the ball valve, hydraulic locking of an actuator in the actuation section of the isolation valve may prevent the ball valve from being able to re-close. Accordingly, there is a need for an improved actuation/mechanical section of the isolation valve that allows the ball valve to re-close after the initial actuation, if desired.

SUMMARY

An isolation valve according to one or more embodiments of the present disclosure includes a ball section having a ball valve element rotatable between an open position and a closed position, an actuation section coupled with the ball section to rotate the ball valve element, and a trigger section that actuates the actuation section, and thus the ball section, in response to a pressure differential. In one or more embodiments of the present disclosure, the actuation section includes, an actuation mandrel including an upper actuation mandrel coupled to a lower actuation mandrel, a piston housing that at least partially encases the actuation mandrel, wherein the piston housing and the actuation mandrel define a hydraulic chamber between an inner diameter of the piston housing and an outer diameter of the actuation mandrel, a collet piston disposed in the piston housing, the collet piston separating the hydraulic chamber into an upper hydraulic chamber and a lower hydraulic chamber, and a holding collet disposed in the piston housing that supports the collet piston during a stroke of the actuation mandrel that is triggered by the trigger section. In one or more embodiments of the present disclosure, the collet piston is configured to assume a rest position on the actuation mandrel before and during the stroke of the actuation mandrel that is triggered by the trigger section, and the piston is configured to disengage from the actuation mandrel after the stroke of the actuation mandrel that is triggered by the trigger section.

A method according to one or more embodiments of the present disclosure includes, actuating a hydraulic piston a single time to shift an actuation mandrel, thereby opening an associated valve, disengaging the hydraulic piston from the actuation mandrel at an end of a stroke of the actuation mandrel, and operating the actuation mandrel after the disengaging step to re-close the associated valve.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various described technologies. The drawings are as follows.

DETAILED DESCRIPTION

In the following description, numerous details are set forth to provide an understanding of some embodiments of the present disclosure. However, it will be understood by those of ordinary skill in the art that that embodiments of the present disclosure may be practiced without these details and that numerous variations or modifications from the described embodiments may be possible.

In the specification and appended claims: the terms "connect," "connection," "connected," "in connection with," "connecting," "couple," "coupled," "coupled with," and "coupling" are used to mean "in direct connection with" or "in connection with via another element." As used herein, the terms "up" and "down," "upper" and "lower," "upwardly" and "downwardly," "upstream" and "downstream," "uphole" and "downhole," "above" and "below," and other like terms indicating relative positions above or below a given point or element are used in this description to more clearly describe some embodiments of the disclosure.

One or more embodiments of the present disclosure are directed to an isolation valve. More specifically, one or more embodiments of the present disclosure are directed to an improved actuation/mechanical section of an isolation valve that allows a ball valve to be re-closed after being initially opened by a one-time remote event facilitated by the trigger section of the isolation valve. Due to the design and configuration described herein, the isolation valve according to one or more embodiments of the present disclosure is able to have an API 19V "Type CC" designation, meaning that the isolation valve may work pre- and post-production. More specifically, the isolation valve may continue to operation to re-close and open the ball valve even after the isolation valve has been remotely opened from the surface. As such, a well operator will be able to mechanically intervene to close the ball valve in a circumstance that requires the reservoir to be isolated again.

Figure 1:
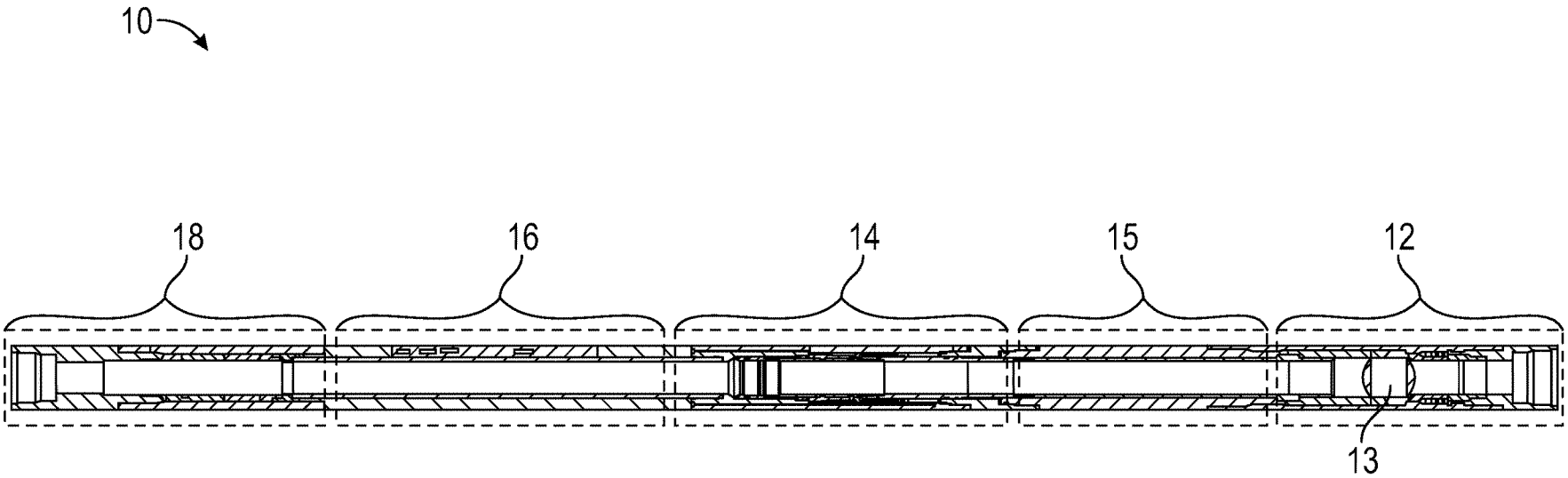
FIG. 1 is an architecture layout for an isolation valve according to one or more embodiments of the present disclosure.

Referring generally to FIG. 1, an architecture layout for an isolation valve 10 according to one or more embodiments of the present disclosure is shown. In one or more embodiments of the present disclosure, the isolation valve 10 may be disposed along a well string to selectively block or allow fluid flow along an interior of the well string. As shown in FIG. 1, the isolation valve 10 according to one or more embodiments of the present disclosure may include a ball section 12 having a ball valve element 13 that is rotatable between an open position and a closed position, for example. According to one or more embodiments of the present disclosure, the isolation valve 10 may also include an actuation/mechanical section 14 coupled with the ball section 12 to rotate the ball valve element 13, thereby opening and closing the ball valve element 13, as further described below. In one or more embodiments of the present disclosure, the actuation/mechanical section 14 may be coupled with the ball section 12 via an extension section 15, for example. In one or more embodiments of the present disclosure, the extension section 15 keeps a shifting profile of the actuation/mechanical section 14 distanced from the ball section 12 so that debris cannot impact the mechanical shifting of the ball valve element 13. As further shown in FIG. 1, the isolation valve 10 may include a trigger section 16 that actuates or triggers the actuation section 14, according to one or more embodiments of the present disclosure. As further shown in FIG. 1, the isolation valve 10 may include a compensator section 18 that provides a reservoir for the trigger section 16 and the actuation section 14, and tubing pressure, according to one or more embodiments of the present disclosure.

Figure 2:
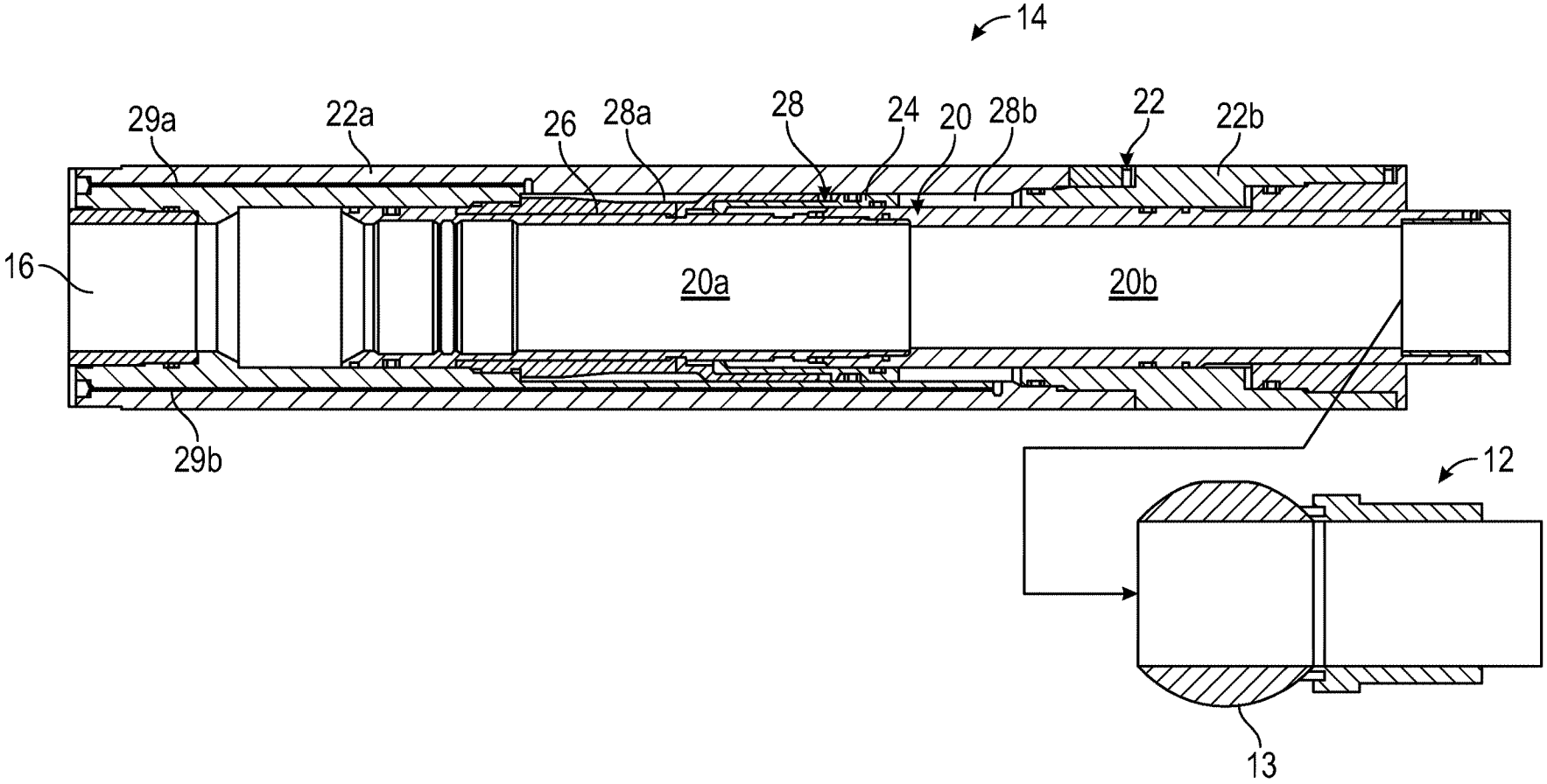
FIG. 2 shows an actuation/mechanical section of an isolation valve in a run in hole position with an open ball valve element, according to one or more embodiments of the present disclosure.

Referring now to FIG. 2, the actuation/mechanical section 14 of the isolation valve 10 is shown in a run in hole position with an open ball valve element 13 according to one or more embodiments of the present disclosure. As shown, the actuation/mechanical section 14 includes an actuation mandrel 20, a piston housing 22, a collet piston 24, and a holding collet 26, according to one or more embodiments of the present disclosure. As shown in FIG. 2, the actuation mandrel 20 may include an upper actuation mandrel 20*a* and a lower actuation mandrel 20*b*, for example. As also shown in FIG. 2, the piston housing 22 at least partially encases the actuation mandrel 20 in one or more embodiments of the present disclosure. The piston housing 22 may include an upper piston housing 22*a* and a lower piston housing 22*b*, for example.

Still referring to FIG. 2, in one or more embodiments of the present disclosure, the piston housing 22 and the actuation mandrel 20 define a hydraulic chamber 28 between an inner diameter of the piston housing 22 and an outer diameter of the actuation mandrel 20. In one or more embodiments of the present disclosure, the actuation mandrel 20 may include at least one seal on either end of the hydraulic chamber 28. As further shown in FIG. 2, the collet piston 24 is disposed in the piston housing 22, according to one or more embodiments of the present disclosure. In this way, the collet piston 24 separates the hydraulic chamber 28 into an upper hydraulic chamber 28*a* and a lower hydraulic chamber 28*b*. In the run in hole position shown in FIG. 2, the upper hydraulic chamber 28*a* and the lower hydraulic chamber 28*b* may have equal pressures. In one or more embodiments of the present disclosure, the equal pressures may be equal tubing pressures supplied from the compensator section 18 via first and second gun drill ports 29*a*, 29*b* provided in the piston housing 22, for example. Because there is an equal tubing pressure across the collet piston 24 in the run in hole position shown in FIG. 2, and thereafter until trigger section 16 actuation, which is further described below, the collet piston 24 remains stationary.

Still referring to FIG. 2, the holding collet 26 is also disposed in the piston housing 22, and the holding collet 26 supports the collet piston 24 in the run in hole position, according to one or more embodiments of the present disclosure. As further described below, the holding collet 26 also supports the collet piston 24 in other operational positions of the actuation/mechanical section 14 of the isolation valve 10. In addition to being disposed in the piston housing 22, the holding collet 26 according to one or more embodiments of the present disclosure may be affixed to at least a portion of the outer diameter of the upper actuation mandrel 20*a*, as shown in FIG. 2 for example.

Figure 3:
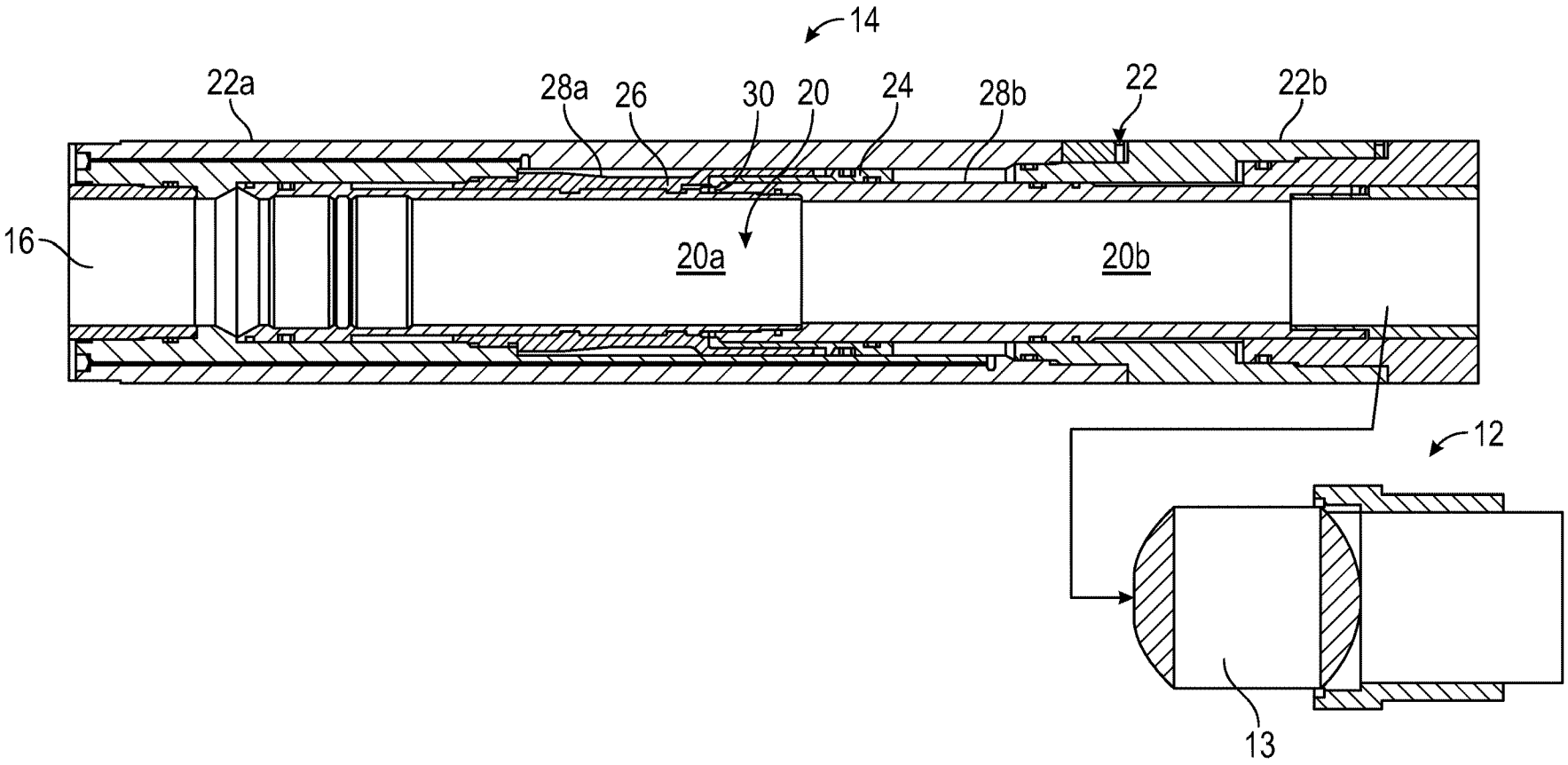
FIG. 3 shows an actuation/mechanical section of an isolation valve in an operational position prior to trigger section actuation with a closed ball valve element, according to one or more embodiments of the present disclosure.

Referring now to FIG. 3, the actuation/mechanical section 14 of the isolation valve 10 is shown in an operational position prior to trigger section 16 actuation with a closed ball valve element 13 according to one or more embodiments of the present disclosure. Specifically, prior to trigger section 16 actuation, FIG. 3 shows that the actuator mandrel 20 has been pulled up or shifted upward until the upper actuation mandrel 20*a* shoulders near the trigger section 10. In one or more embodiments of the present disclosure, the actuator mandrel 20 may be pulled up or shifted upward using a mechanical shifting tool, for example. Linearly shifting the actuator mandrel 20 upward enables rotation of the ball valve element 13 of the ball section 12 until the ball valve element 13 assumes a closed position. As also shown in FIG. 3, linearly shifting the actuator mandrel 20 upward also causes the collet piston 24 to rest on an angled bevel 30 of the actuation mandrel 20, while the holding collet 26 continues to support the collet piston 24 on the outer diameter of the collet piston 24. In one or more embodiments of the present disclosure, the angled bevel 30 may be disposed on the lower actuation mandrel 20*b* of the actuation mandrel 20.

Figure 4:
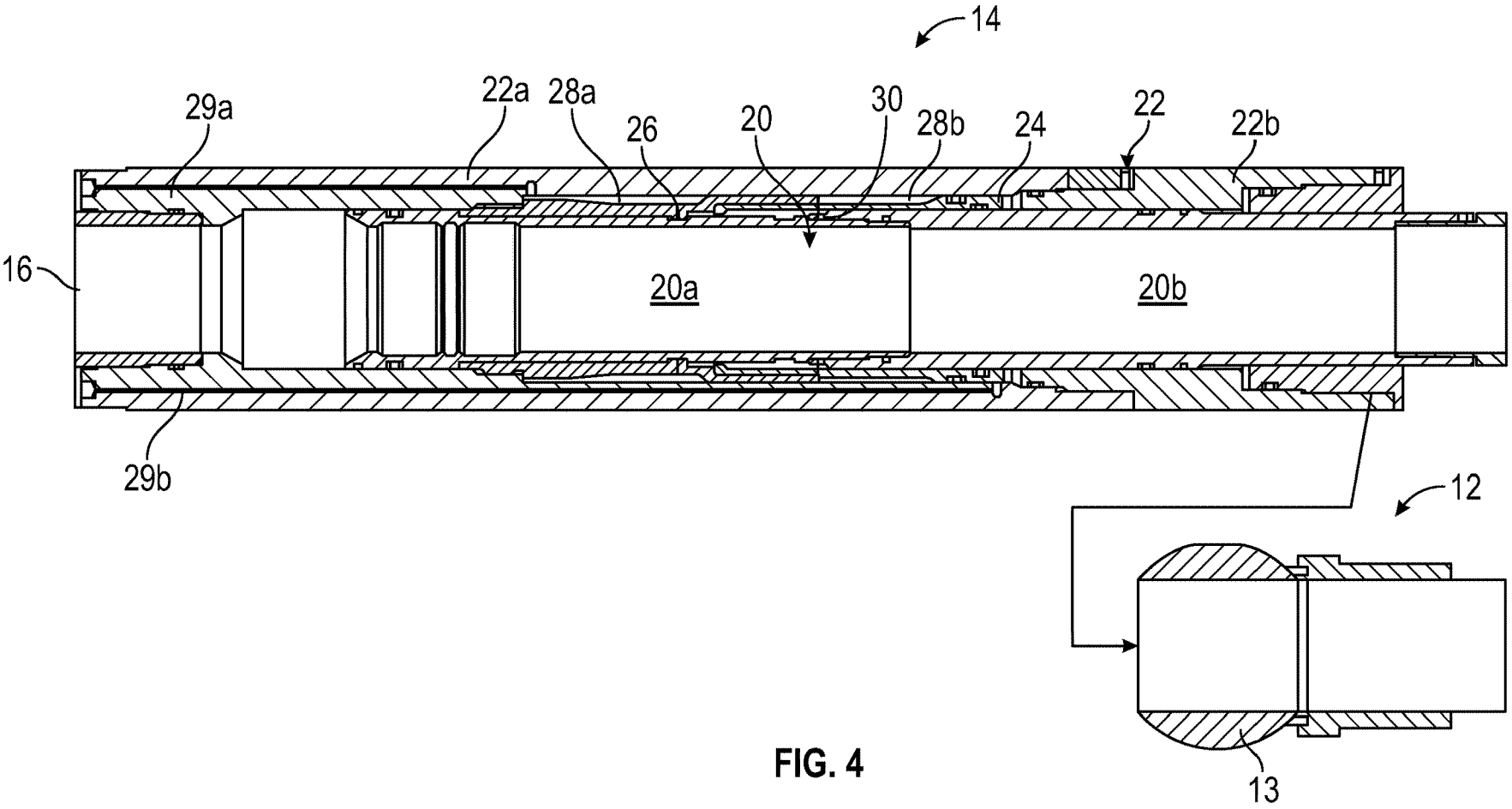
FIG. 4 shows an actuation/mechanical section of an isolation valve in an operational position after trigger section actuation with an open ball valve element, according to one or more embodiments of the present disclosure.

Referring now to FIG. 4, the actuation/mechanical section 14 of the isolation valve 10 is shown in an operational position after trigger section 16 actuation with an open ball valve element 14 according to one or more embodiments of the present disclosure. To initiate trigger section 16 actuation, a separate trigger mechanism of the trigger section 16 causes the upper hydraulic chamber 28*a* and the lower hydraulic chamber 28*b* to be dis-communicated, creating a pressure differential in the hydraulic chamber 28. Specifically, in one or more embodiments of the present disclosure, the trigger section 16 or "trip saver" section may be controlled according to a pressure signature applied from the surface or from another suitable location. The trigger section 16 may include a housing having at least one piston, and the trigger section 16 housing may be coupled with the actuation/mechanical section 14. Moreover, the trigger section 16 may be able to communicate with the gun drill ports 29*a*, 29*b* provided in the piston housing 22.

When it is time to initiate the trigger section 16 actuation, the pressure signature may be applied to the trigger section 16, actuating the at least one piston of the trigger section 16, and causing the lower hydraulic chamber 28*b* to bleed pressure via the lower gun drill port 29*b*. In one or more embodiments of the present disclosure, the pressure signature is applied remotely, and the trigger section 16 may be actuated only one time via the pressure signature. That is, the trigger section 16 is configured to actuate the actuation section 14 only one time to shift the actuation mandrel 20 via downward movement of the collet piston 24, as further described below. As fluid bleeds out of the lower hydraulic chamber 28*b*, the tubing pressure in the lower gun drill port 29*b* is replaced with atmospheric pressure, and a pressure differential is created across the collet piston 24.

Figure 5:
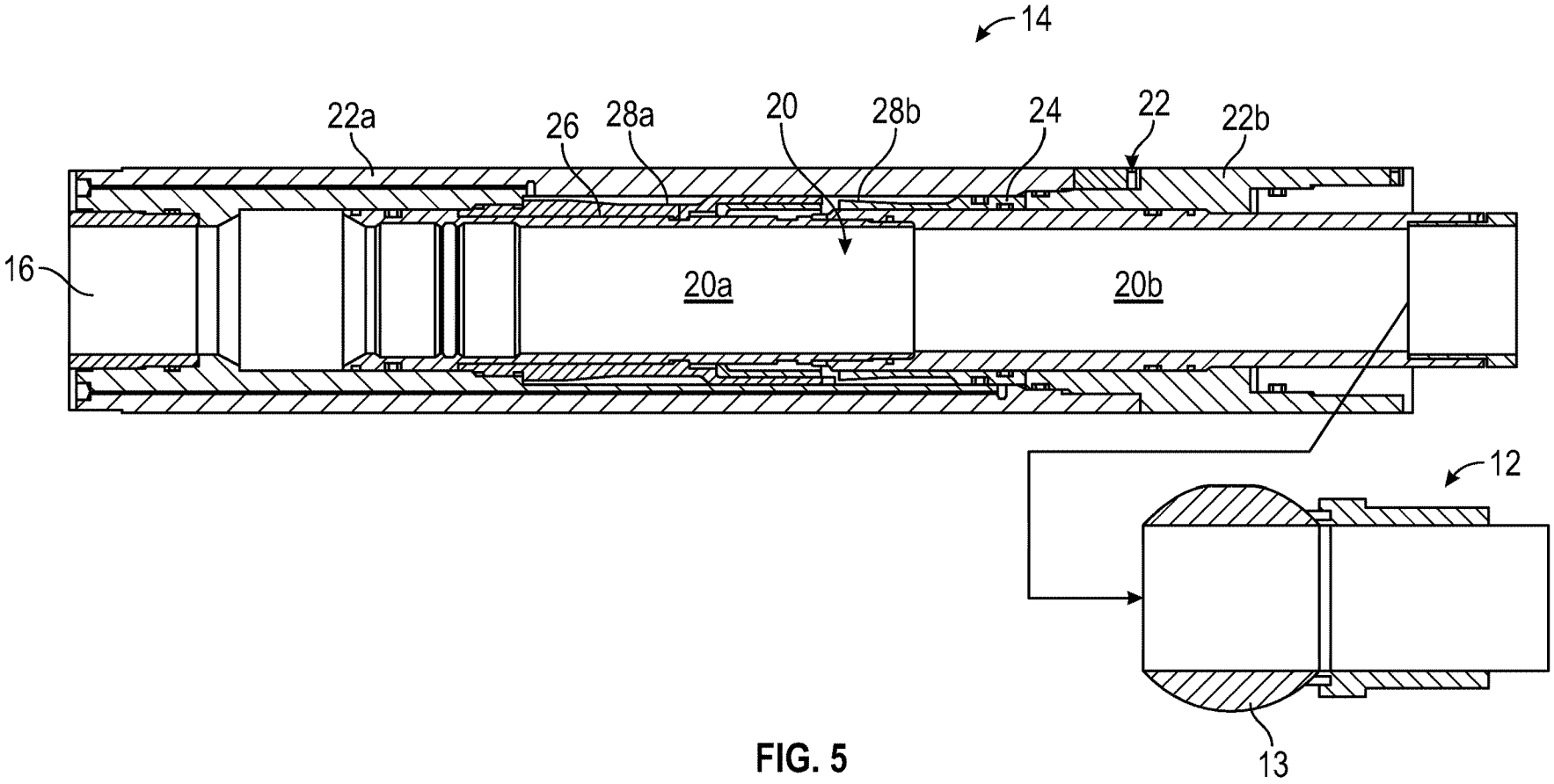
FIG. 5 shows an actuation/mechanical section of an isolation valve in an operational position after a collet piston of the actuation/mechanical section becomes disengaged with an open ball valve element, according to one or more embodiments of the present disclosure.

Still referring to FIG. 4, the pressure differential created across the collet piston 24 causes the collet piston 24 to begin to stroke in a downward direction. When the collet arms of the collet piston 24 begin to move axially, the collet arms engage the beveled surface 30 of the actuation mandrel 20, and the collet arms of the collet piston 24 remain engaged with the beveled surface 30 of the actuation mandrel 20 throughout the stroke of actuation. Moreover, according to one or more embodiments of the present disclosure, the holding collet 26 continues to support the collet piston 24 during the stroke of the actuation mandrel 20. Advantageously, supporting the collet arms of the collet piston 24 through the stroke of the actuation mandrel 20 allows high actuation force generation of 80,000 lbf or more, for example. During the stroke of actuation, the collet piston 24 continues to translate in the downward direction, pulling the actuation mandrel 20 with it, which pushes the entire mandrel string down to open the ball valve element 13, as shown in FIG. 4, for example. At the end of the stroke of the actuation mandrel 20, the collet arms of the collet piston 24 are no longer supported by the holding collet 26 on their outer diameter, which allows the collet fingers to release from the beveled surface 30 of the actuation mandrel 20 (i.e., disengage from the actuation mandrel 20), as shown in FIG. 5, which is further described below. In one or more embodiments of the present disclosure, the stroke of the actuation mandrel 20 ends when the actuation mandrel 20 shoulders against an end of the holding collet 26, as shown in FIG. 4, for example.

Referring now to FIG. 5, the actuation/mechanical section 14 of the isolation valve 10 is shown in an operational position after the collet piston 24 of the actuation/mechanical section 14 becomes disengaged from the actuation mandrel 20 with an open ball valve element 13, according to one or more embodiments of the present disclosure. As shown in FIG. 5, after the collet piston 24 disengages from the actuation mandrel 20, the collet piston 24 is free to continue its downward stroke along an outer diameter of the actuation mandrel 20 until the collet piston 24 shoulders against an end of the lower piston housing 22*b*. In one or more embodiments of the present disclosure, hydraulic locking, an effect of the aforementioned trigger section 16 actuation, may be harnessed to facilitate disengagement of the collet piston 24 from the actuation mandrel 20 and the locking of the collet piston 24 in place after the collet piston 24 shoulders against the lower piston housing 22*b*. By allowing the collet piston 24 to stroke down and simply mechanically disengage from the actuation mandrel 20, the hydraulic lock of the collet piston 24 (i.e., upper hydraulic chamber 28*a* pressure>lower hydraulic chamber 28*b* pressure) does not prevent mechanical shifting of the actuation mandrel 20 after trigger section 16 actuation.

Figure 6:
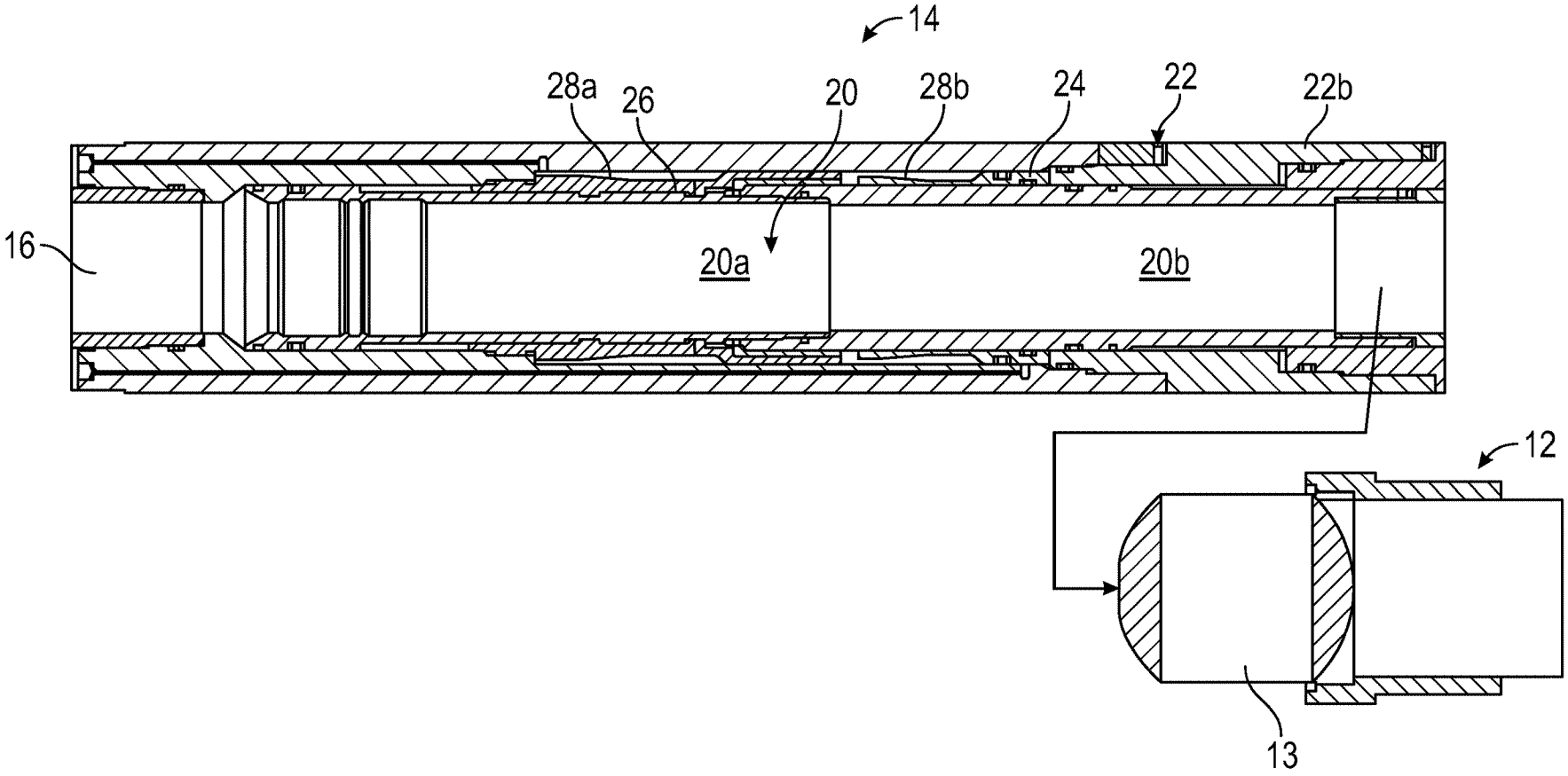
FIG. 6 shows an actuation/mechanical section of an isolation valve in an operational position after disengagement of the collet piston with a re-closed ball valve element.

Referring now to FIG. 6, the actuation/mechanical section 14 of the isolation valve 10 is shown in an operational position after disengagement of the collet piston 24 with a re-closed ball valve element 13, according to one or more embodiments of the present disclosure. Once the collet piston 24 has disengaged from the actuation mandrel 20 and is hydraulically locked in place as previously described, the actuation mandrel 20 is free from the collet piston 24, and may be mechanically pulled up or otherwise shifted in an upward direction to close the ball valve element 13. In one or more embodiments of the present disclosure, the actuator mandrel 20 may be pulled up or shifted upward using a mechanical shifting tool, for example. Linearly shifting the actuation mandrel 20 upward enables rotation of the ball valve element 13 of the ball section 12 until the ball valve element 13 assumes a re-closed position. In one or more embodiments of the present disclosure, the actuation mandrel 20 may be mechanically shifted to re-open the ball valve element 13 after the ball valve element 13 is re-closed. Advantageously, one or more embodiments of the present disclosure allows the actuation mandrel 20 of the actuation/mechanical section 14 to continue to be operated mechanically to open and close the ball valve element 13 after trigger section 16 actuation.

Figure 7:
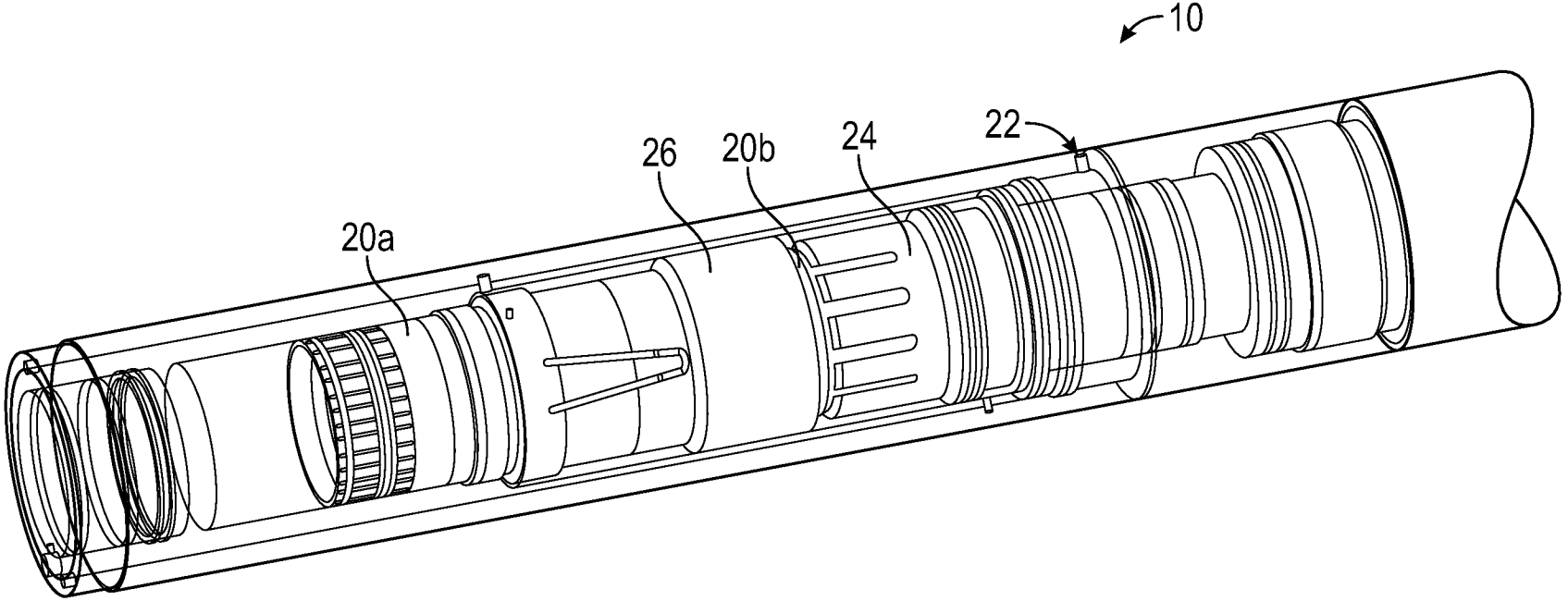
FIG. 7 shows an isometric view of an isolation valve with a transparent piston housing in an operational position, according to one or more embodiments of the present disclosure.

Referring now to FIG. 7, an isometric view of an isolation valve 10 with a transparent piston housing 22 is shown in an operational position, according to one or more embodiments of the present disclosure. More specifically, FIG. 7 provides an additional view that shows the isolation valve at the end of trigger section 16 actuation, where the ball valve element 13 would be in an open position. As further shown in FIG. 7, the collet arms of the collet piston 24 are disengaged from the actuation mandrel 20.

Additional advantages may be realized by one or more embodiments of the present disclosure. For example, the isolation valve according to one or more embodiments of the present disclosure may be used in higher reservoir pressures, as understood by those having ordinary skill in the relevant art. With only the actuation mandrel 20 and the piston housing 22 seeing the full hydrostatic burst/collapse pressure, these components may be designed to be thicker, and thus, may be able to withstand higher downhole pressures.

Further, one or more embodiments of the present disclosure may reduce the cost of isolation valve products. Indeed, by implementing one or more of the concepts described herein, the mechanical section 14 of the isolation valve 10 may be simplified insofar as the actuation mandrel 20 may be held with a simple holding collet 26.

Although embodiments of the present disclosure have been described with respect to isolation valves, embodiments of the present disclosure may also be used in any product utilizing a ball valve in which the freedom to continuously re-close and then re-open the ball valve is desired after a remote triggering actuation event. Moreover, one or more embodiments of the present disclosure may also be used in any design that requires a linear stroke of an internal mandrel string that must be de-coupled from the piston after its use.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. An isolation valve comprising:

a ball section having a ball valve element rotatable between an open position and a closed position;

an actuation section coupled with the ball section to rotate the ball valve element; and a trigger section that actuates the actuation section, and thus the ball section, in response to a pressure differential, wherein the actuation section comprises:

an actuation mandrel comprising an upper actuation mandrel coupled to a lower actuation mandrel;

a piston housing that at least partially encases the actuation mandrel, wherein the piston housing and the actuation mandrel define a hydraulic chamber between an inner diameter of the piston housing and an outer diameter of the actuation mandrel;

a collet piston disposed in the piston housing, the collet piston separating the hydraulic chamber into an upper hydraulic chamber and a lower hydraulic chamber; and a holding collet disposed in the piston housing that supports the collet piston during a stroke of the actuation mandrel that is triggered by the trigger section, wherein the collet piston is configured to assume a rest position on the actuation mandrel before and during the stroke of the actuation mandrel that is triggered by the trigger section, and wherein the collet piston is configured to disengage from the actuation mandrel after the stroke of the actuation mandrel that is triggered by the trigger section.

2. The isolation valve of claim 1, wherein the piston housing comprises: a first gun drill port that connects to the upper hydraulic chamber; and a second gun drill port that connects to the lower hydraulic chamber.

3. The isolation valve of claim 2, wherein the upper hydraulic chamber and the lower hydraulic chamber are communicated at a tubing pressure prior to actuation by the trigger section.

4. The isolation valve of claim 1, wherein the upper hydraulic chamber and the lower hydraulic chamber are communicated at a tubing pressure prior to actuation by the trigger section.

5. The isolation valve of claim 1, wherein the actuation mandrel actuates linearly to rotate the ball valve element between the open position and the closed position.

6. The isolation valve of claim 1, wherein the trigger section is configured to actuate the actuation section only one time to shift the actuation mandrel via downward movement of the collet piston.

7. The isolation valve of claim 1, wherein, in the rest position, the collet piston rests on an angled bevel of the actuation mandrel while being supported by the holding collet on an outer diameter of the collet piston.

8. The isolation valve of claim 1, wherein the actuation mandrel comprises at least one seal on either end of the hydraulic chamber.

9. A system for use in a well, comprising:

a well string having the isolation valve of claim 1 disposed along the well string to selectively block or allow fluid flow along an interior of the well string.

10. A method comprising:

deploying a well string having the isolation valve of claim 1 downhole in a wellbore, wherein the ball valve element is in the open position during the deploying step, and wherein the upper hydraulic chamber and the lower hydraulic chamber have equal pressures during the deploying step;

shifting the actuation mandrel to close the ball valve element, which causes the collet piston to rest on an angled bevel of the actuation mandrel;

using the trigger section to create the pressure differential between the upper hydraulic chamber and the lower hydraulic chamber;

stroking the actuation mandrel via the collet piston to open the ball valve element in response to the pressure differential;

disengaging the collet piston from the actuation mandrel such that the collet piston no longer rests on the angled bevel of the actuation mandrel; and shouldering the collet piston on a lower portion of the piston housing.

11. The method of claim 10, further comprising:

shifting the actuation mandrel after the shouldering step to re-close the ball valve element.

12. The method of claim 11, further comprising:

shifting the actuation mandrel after re-closing the ball valve element to re-open the ball valve element.

13. The method of claim 11, wherein the using the trigger section step occurs only one time to facilitate stroking of the actuation mandrel via the collet piston.

14. The method of claim 10, wherein the using the trigger section step comprises initiating a remote open triggering event.

15. The method of claim 10, wherein, after the stroking step and before the disengaging step, the holding collet no longer supports the collet piston, and the collet piston continues to rest on the angled bevel of the actuation mandrel.

* * * * *